US007331136B2

(12) United States Patent
Geissele

(10) Patent No.: US 7,331,136 B2
(45) Date of Patent: Feb. 19, 2008

(54) ADJUSTABLE DUAL STAGE TRIGGER MECHANISM FOR SEMI-AUTOMATIC WEAPONS

(76) Inventor: William Hugo Geissele, 603 Caroline Dr., Norristown, PA (US) 19401

( * ) Notice: Subject to any disclaimer, the term of this patent is extended or adjusted under 35 U.S.C. 154(b) by 0 days.

(21) Appl. No.: 11/254,412

(22) Filed: Oct. 20, 2005

(65) Prior Publication Data

US 2006/0086031 A1 Apr. 27, 2006

Related U.S. Application Data

(60) Provisional application No. 60/621,133, filed on Oct. 22, 2004.

(51) Int. Cl.
*F41A 3/00* (2006.01)

(52) U.S. Cl. ..... 42/69.03; 89/139; 89/140

(58) Field of Classification Search ..... 42/69.03; 89/139, 140
See application file for complete search history.

(56) References Cited

U.S. PATENT DOCUMENTS 5,501,134 A * 3/1996 Milazzo et al. ..... 89/139
6,131,324 A * 10/2000 Jewell ..... 42/69.03
6,772,548 B1 * 8/2004 Power ..... 42/69.03

* cited by examiner

*Primary Examiner*—Michael J. Carone
*Assistant Examiner*—Gabriel J Klein

(57) ABSTRACT

A dual stage trigger assembly for a firearm. The trigger assembly comprises a spring loaded lightweight hammer, a spring loaded trigger, a spring loaded disconnector, a spring follower for the disconnector spring and two adjustment screws that allow the user the ability to adjust the sear face of the trigger that is engaged with the hammer in the cocked position and adjust the force imparted to the disconnector by the disconnector spring.

3 Claims, 8 Drawing Sheets

FIG. 3
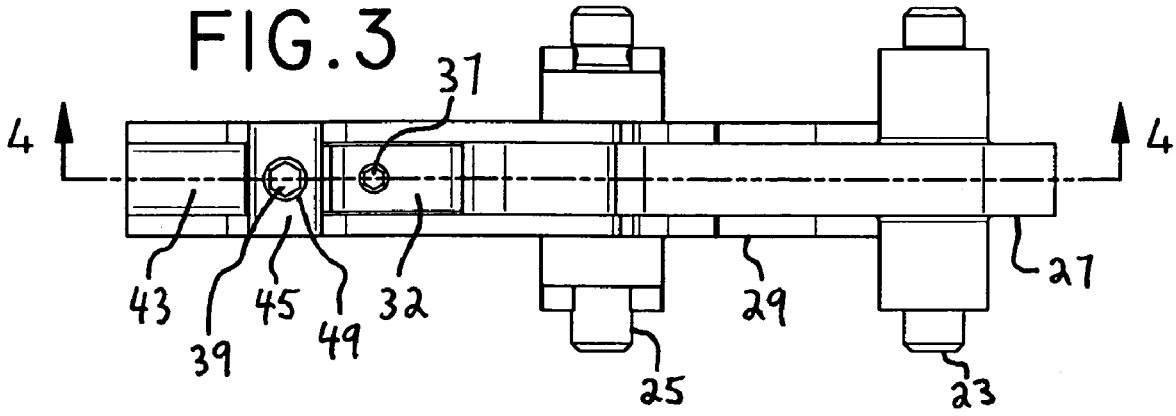
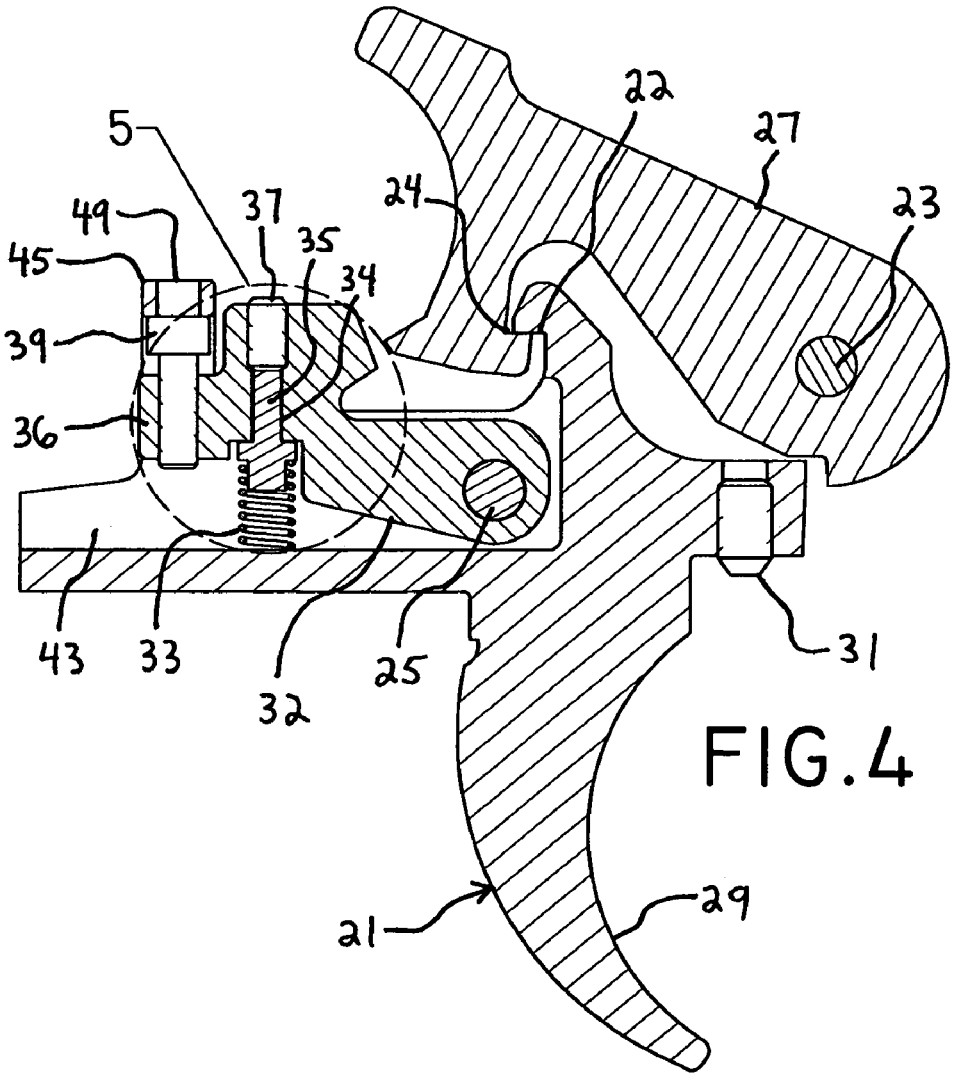
FIG. 4

ADJUSTABLE DUAL STAGE TRIGGER MECHANISM FOR SEMI-AUTOMATIC WEAPONS

RELATED APPLICATIONS

This application claims benefit of Provisional Patent Application Ser. No.: 60/621,133, filed 22 Oct. 2004, titled: Adjustable Dual Stage Trigger Mechanism for Semi-Automatic Weapons.

FIELD OF INVENTION

This invention pertains to trigger mechanisms for fire arms and more particularly to a dual stage trigger mechanism for semi-automatic weapons.

BACKGROUND OF THE INVENTION

This invention relates to trigger mechanisms for semi-automatic firearms. Particularly, the invention relates to trigger mechanisms for the AR15 and M16 type rifles but with modifications may be used in other firearms. Related prior art is U.S. Pat. No. 6,131,324 issued Oct. 17, 2000 to Jewell, and U.S. Pat. No. 5,501,134 issued Mar. 26, 1996 to Milazzo. Jewell discloses a dual stage trigger assembly that allows user adjustability of sear engagement and disconnector spring force. A disconnector in Jewell is double ended with two distinct ends across the disconnector pivot point. At each end of the disconnector in Jewell is an adjustment screw. Jewell has located the first disconnector adjustment screw on the end toward the hammer. This screw will adjust the sear engagement between the trigger and hammer at the second stage let off point. On the end away from the hammer is the second adjustment screw that allows the force of the disconnector spring to be varied which will change the amount of resistance the shooter feels when pulling through the second stage to fire the weapon. Jewell's design also incorporates a unique user adjustable torsion spring that allows the user to adjust the first stage trigger pull weight. Jewell has designed a non-standard hammer spring for use with the double ended disconnector and unique torsion spring adjustable trigger. Some non-standard springs have been shown to provide reduced force over a standard hammer spring. Reduced force imparted into the hammer will allow the time of rotation of the hammer to increase over the time of rotation of an identical hammer using a stronger standard hammer spring, an undesirable situation for a shooter as the potential is increased for misalignment of firearm sights during the longer hammer fall time. The use of a standard hammer spring is also desirable from a spare parts perspective as an organization that uses M16 trigger mechanisms will not have to stock a different, special hammer spring over the standard hammer springs they now stock as spare parts.

Another dual stage user adjustable trigger is Milazzo's which allows the user to adjust sear engagement and second stage pull weight, although both adjustments are done by one screw and are not independent of each other. A distinct feature of Milazzo's trigger mechanism is the disconnector adjustment screw threadedly engaged to the trigger. Threading the screw into the trigger requires the threaded stem of the screw to bear directly on the disconnector. The cyclic sudden deceleration action of the disconnector during the weapon firing cycle has a tendency to batter the end of the threaded portion of the adjustment screw thereby changing the sear adjustment over time and distorting the screw threads such that the disconnector adjustment screw may not be easily removed for maintenance purposes.

SUMMARY OF THE INVENTION

The present invention places the sear engagement screw and disconnector force adjustment screw on the same end of the disconnector that is away from the hammer allowing use of a conventional, non-adjustable trigger spring and conventional trigger geometry that will allow a standard hammer spring to be used. Due to space constraints placing both adjustment screws on one end of the disconnector is difficult. An adjustment screw of sufficient diameter that will bear directly on the disconnector spring cannot be fitted to the disconnector in the space available in the lower receiver on most AR15 rifles. In order to overcome this limitation the present invention employs a slideable spring follower that will enable an adjustment screw of smaller diameter than the required diameter of the disconnector spring to be employed. The spring follower has a cylindrical portion that slides in the adjustment screw hole and has a larger cylindrical portion that acts as a rest for the disconnector spring and has an additional cylindrical portion that acts as a locator and guide for the disconnector spring.

The instant invention also presents an improvement over Milazzo's disconnector adjustment screw by threadedly engaging the adjustment screw into the disconnector rather than the trigger and allowing the head of the screw to act as a stop against the trigger by the use of a tower that extends over the disconnector. The subtended area of the head of the present invention's adjustment screw is larger than the area subtended by the end of the threaded shank of the screw. The larger area resists the battering force of the pivoting disconnector and damage to the screw threads is eliminated as the screw is supported by a sufficient length of thread engagement into the disconnector.

A further improvement of the present invention is a lightweight yet strong hammer that allows the hammer to rotate faster under the force of the hammer spring than a standard hammer. It is well known in the art that hammer mass may be reduced by drilling holes or making apertures in firearm hammers but this method reduces the hammers strength. The hammer of the instant invention reduces hammer mass by incorporating an "I-beam" shape to the hammer. It is well known that one of the lightest, yet strong and stiff structural members is an I-beam as the I-beam concept of a thin centrally located web with extending flanges at the ends of the web makes very efficient use of the structural member's material. The hammer of the present invention uses the I-beam concept to reduce hammer mass while retaining hammer strength so that the hammer can withstand the repeated impact imparted to the hammer body during the firing cycle while still being lightweight.

BRIEF DESCRIPTION OF THE DRAWINGS

The foregoing and further and more specific objects and advantages of the invention will become readily apparent to those skilled in the art from the following detailed description of a preferred embodiment thereof taken in conjunction with the drawings, in which:

FIG. 3 is a plan view of the trigger mechanism of FIG. 1;

FIG. 4 is a sectional view on the line 4-4 of FIG. 3;

DETAILED DESCRIPTION OF THE PREFERRED EMBODIMENT

Figure 1:
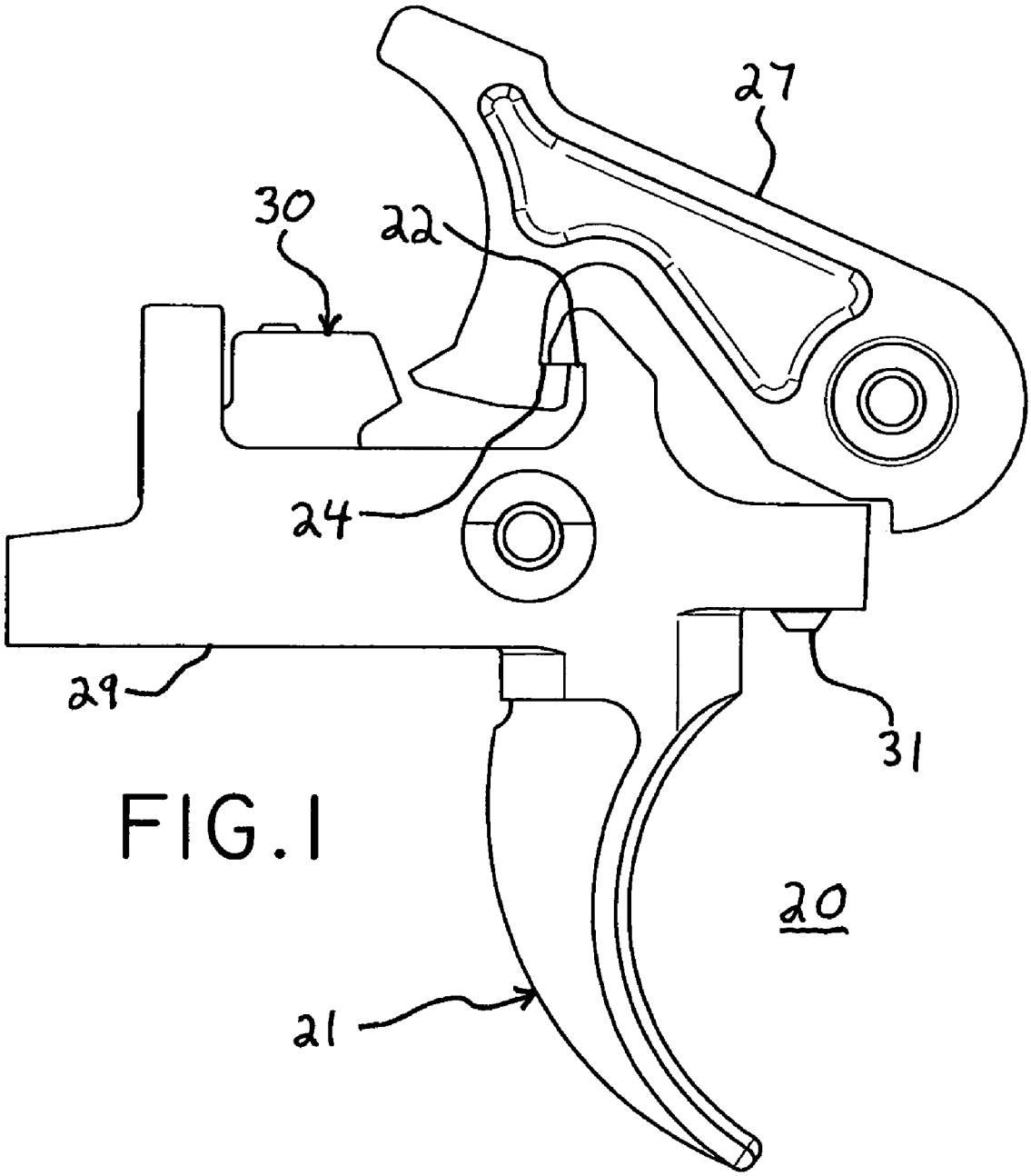
FIG. 1 is a side elevation view of a trigger mechanism according to the present invention.

The present invention is now described in conjunction with the drawings in which like reference characters indicate corresponding elements throughout the several views. Attention is first directed to FIG. 1 which illustrates the trigger mechanism, generally designated 20 and FIG. 2 which is an exploded view of the trigger mechanism 20 of FIG. 1. It will be understood that trigger mechanism 20 is intended to be employed with any of the various M16 type firearms; however with minor modifications it could be more widely used for other firearms as well. M16 type firearms include the AR15 family of rifles, the M4 carbine family of rifles, the SR25 and AR10 larger caliber type M16 rifles and other rifles that use the AR15 trigger assembly. It will also be understood that trigger mechanism 20 is carried by a lower receiver of a firearm. A lower receiver is not shown, as they are well known in the art and trigger mechanism 20 is carried in the conventional manner using cross pins 23 and 25. Trigger mechanism 20 has a spring loaded trigger assembly 21 having a trigger sear hook 22 and a spring loaded hammer 27 having a hammer sear hook 24. The trigger assembly spring and hammer spring are omitted for clarity. Trigger assembly 21 includes a trigger 29, spring loaded disconnector assembly 30 and trigger travel stop screw 31. The trigger assembly 21 is pivotally connected to cross pin 25 that passes from one side of trigger 29 through disconnector assembly 30 and through opposite side of trigger 29. In the cocked position shown in FIG. 1 the trigger sear hook 22 is fully engaged in hammer sear hook 24.

Figure 2:
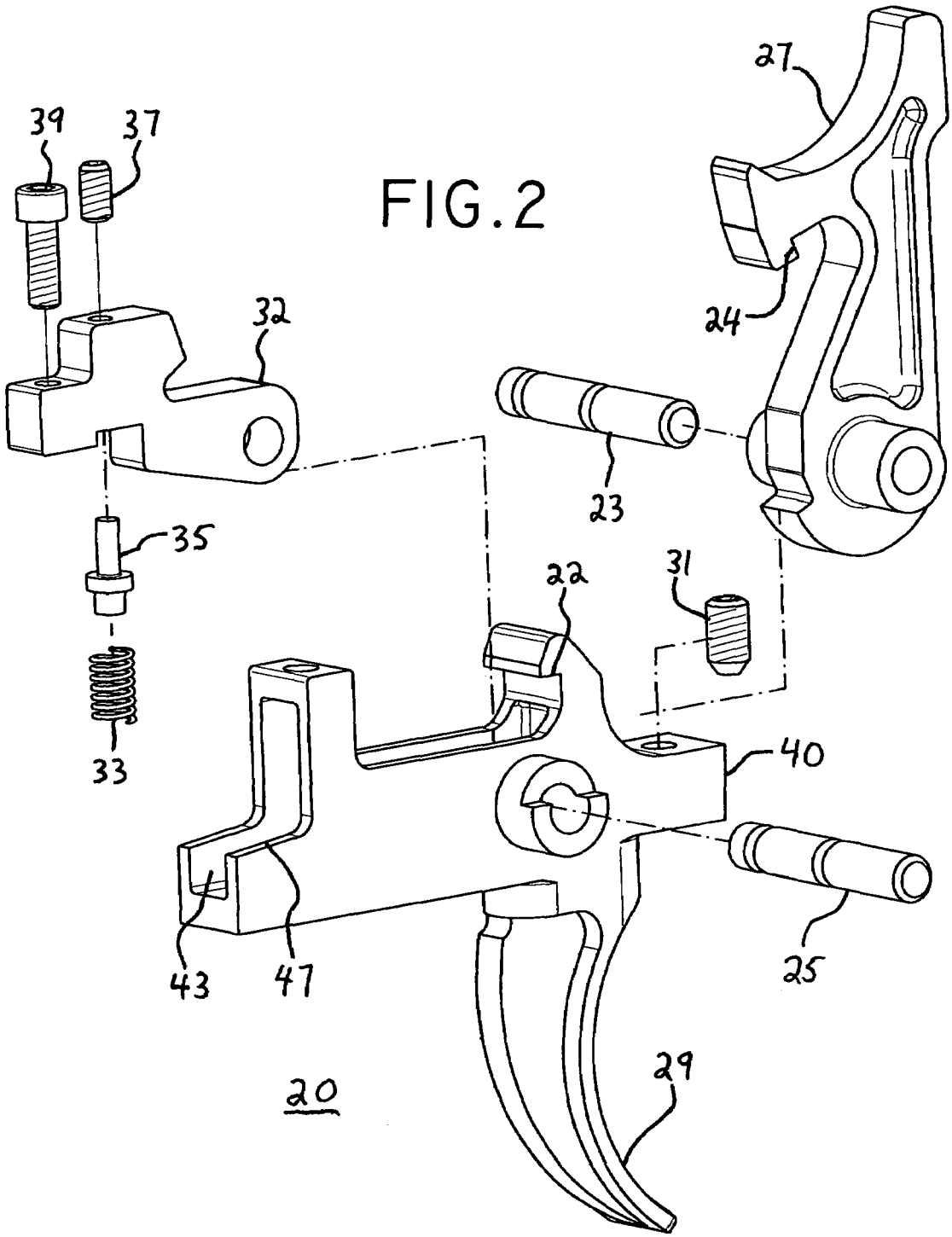
FIG. 2 is an exploded, perspective view of a trigger mechanism according to the present invention.

Referring to FIG. 2, disconnector assembly 30 includes a disconnector 32, disconnector spring 33, spring follower 35, spring follower adjustment screw 37 and sear contact adjustment screw 39. Trigger 29 has a nose 40 at one end and a trough 43 formed therein extending from the opposing end. Trough 43 includes an overhanging tower 45 and the end of trough 43 forms the safety bearing area 47. A selected safety cam is not shown for clarity.

Turning to FIG. 3 which is a plan view of the trigger mechanism of FIG. 1, the trough 43 is clearly shown into which the disconnector assembly 30 resides. Also shown is the overhanging tower 45 which covers the head of the sear contact engagement screw 39. Visible in the top of tower 45 is an aperture 49 which allows access to the sear contact engagement screw 39 by a suitable screw adjusting tool such as an Allen Key that is not shown for clarity.

Referring to FIG. 4 which is a sectional view of FIG. 3 on the line 4-4 the disconnector 32 pivots on a trigger pivot pin 25 and bears on the surface of the trigger pivot pin 25. Hammer sear hook 24 and trigger sear hook 22 form the trigger and hammer engagement means. In the cocked position shown in FIG. 4 the hammer notch 24 is fully engaged in trigger sear 22. Pulling the trigger 29 causes the trigger 29 and disconnector assembly 30 to rotate about trigger pivot pin 25 and pull the trigger sear hook 22 off the hammer sear hook 24. A portion of spring follower 35 is made slightly smaller than a hole 34 for the spring follower adjustment screw 37 such that spring follower 35 is free to slide in hole 34. Spring follower adjustment screw 37 is threaded into hole 34 and bears against the spring follower 35. Screwing the spring follower adjustment screw 37 into the hole 34 will push the spring follower down the hole 34 and closer to the bottom of trough 43. Conversely, screwing the spring follower adjustment screw 37 out of hole 34 will allow the spring follower to move away from the bottom of trough 43. As spring follower 35 moves closer or farther away from bottom of trough 43 spring 33 is compressed or extended as the case may be. By allowing the user to vary the compression of spring 33 the force imparted to disconnector 32 may be varied. Again referring to FIG. 4, the sear contact adjustment screw 39 is user adjustable such that the distance from the surface of the top of screw head 39 to disconnector extension 36 may be varied. Since disconnector 32 is free to pivot on trigger pivot pin 25 and is pushed up in the clock-wise direction by the spring 33, head of sear engagement adjustment screw 39 bears against tower 45 which acts as a stop point for rotation of the disconnector 32. By adjusting the sear engagement screw 39 the rotational position of disconnector 32 may be varied with respect to the trigger 29.

Figure 5:
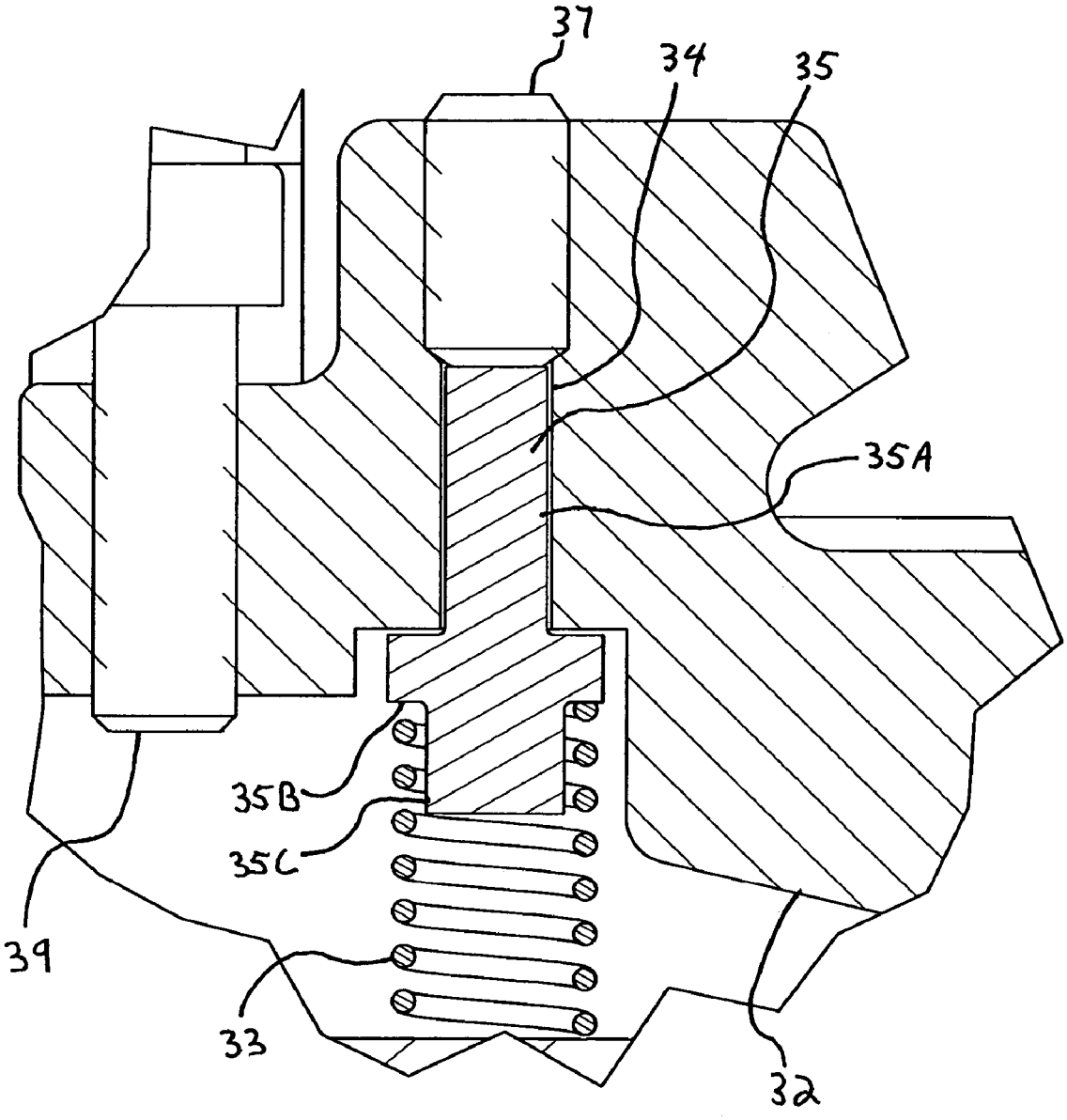
FIG. 5 is an enlarged view of a particular area of FIG. 4 subtended by the dashed circle in FIG. 4, labeled 5.

Additionally, FIG. 5 is an enlarged view of hole 34, spring follower 35, spring 33 and spring follower adjustment screw 37. FIG. 5 clearly shows the sliding interface between spring follower 35 and hole 34. The function of the spring follower is also apparent in FIG. 5 as FIG. 5 shows the greater diameter of spring 33 in relation to screw 37. Due to space constraints it is difficult to size screw 37 and hole 34 such that spring 33 can slide within hole 34. Upper post 35A of spring follower 35 is sized to slide in hole 34 with about a diametric clearance of 0.001 inch. Flange 35B of spring follower 35 acts as a seat for spring 33 and lower post 35C of spring follower 35 locates and guides spring 33. Spring follower 35 allows a screw 37 the ability to adjust spring 33 even if the diameter of spring 33 is greater than the diameter of screw 37 and hole 34.

Figure 6:
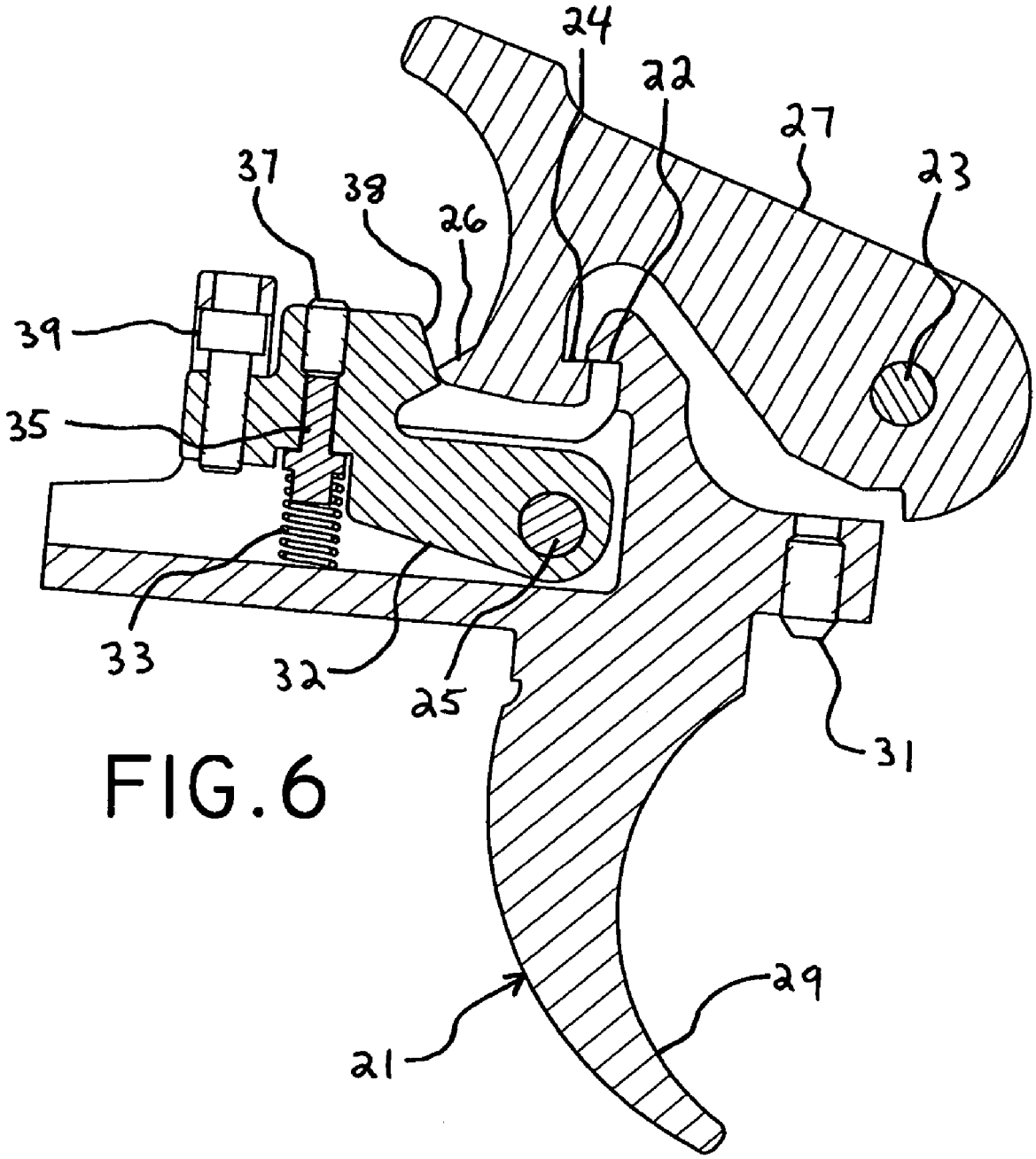
FIG. 6 is a sectional view of the trigger mechanism in FIG. 4 with the exception that the trigger has been pulled to a point just before the hammer release point.

Turning to FIG. 6, which is a sectional view of the trigger mechanism 20 where the trigger mechanism 20 is in a cocked position similar to FIG. 4 but with the trigger 29 pulled thereby rotating the trigger assembly 21 clockwise around trigger pivot pin 25 while overcoming resistance of a trigger spring that is not shown for clarity. In FIG. 6 the trigger 29 has been pulled until the secondary sear hook 26 of hammer 27 has contacted disconnector face 38 of disconnector 32 and overlap of the hammer sear hook 24 and trigger sear hook 22 has been reduced. At this point in the process of pulling the trigger 29 the shooter will feel a distinct stop point where the secondary sear hook 26 of hammer 27 is attempting to rotate disconnector 32 around trigger pivot pin 25 in a counter-clockwise direction. The location of this stop point controls the amount of overlap left on the hammer sear hook 24 and trigger sear hook 22 and marks the end of the $1^{st}$ stage of trigger pull. A minimal amount of overlap is desired as only a slight amount of additional pressure on the trigger 29 will rotate the disconnector counter-clockwise and allow the trigger sear hook 22 to slip off the hammer sear hook 24 thereby allowing the hammer 27 to rotate under the force of the trigger spring and strike the firing pin, discharging the firearm. This slight additional pressure on trigger 29 is known as the $2^{nd}$ stage and allows the shooter to carefully align his sights on target and at the appropriate moment the slight additional pressure on trigger 29 will allow the firearm to discharge without disturbing the alignment of the firearm sights. The sear engagement screw 39 allows the user to adjust the location of the $1^{st}$ stage stop point and thereby control the amount of overlap remaining on the hammer sear hook 24 and trigger sear hook 22. The spring follower adjustment screw 37 allows the user to adjust the force required by the trigger 29 to rotate the disconnector 32 counter-clockwise thereby adjusting the force needed to pull the trigger 29 through the $2^{nd}$ stage and discharge the firearm.

Figure 7:
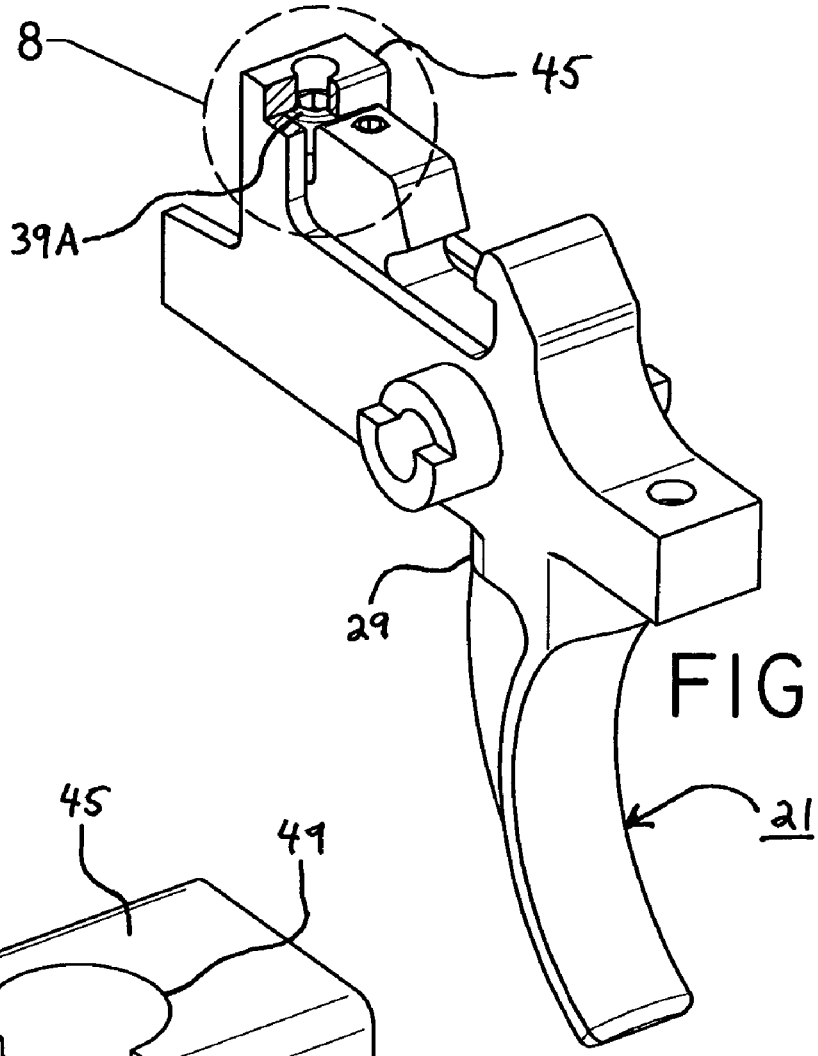
FIG. 7 is a perspective view, partially broken open, of the trigger assembly that is part of the trigger mechanism-according to the present invention.
Figure 8:
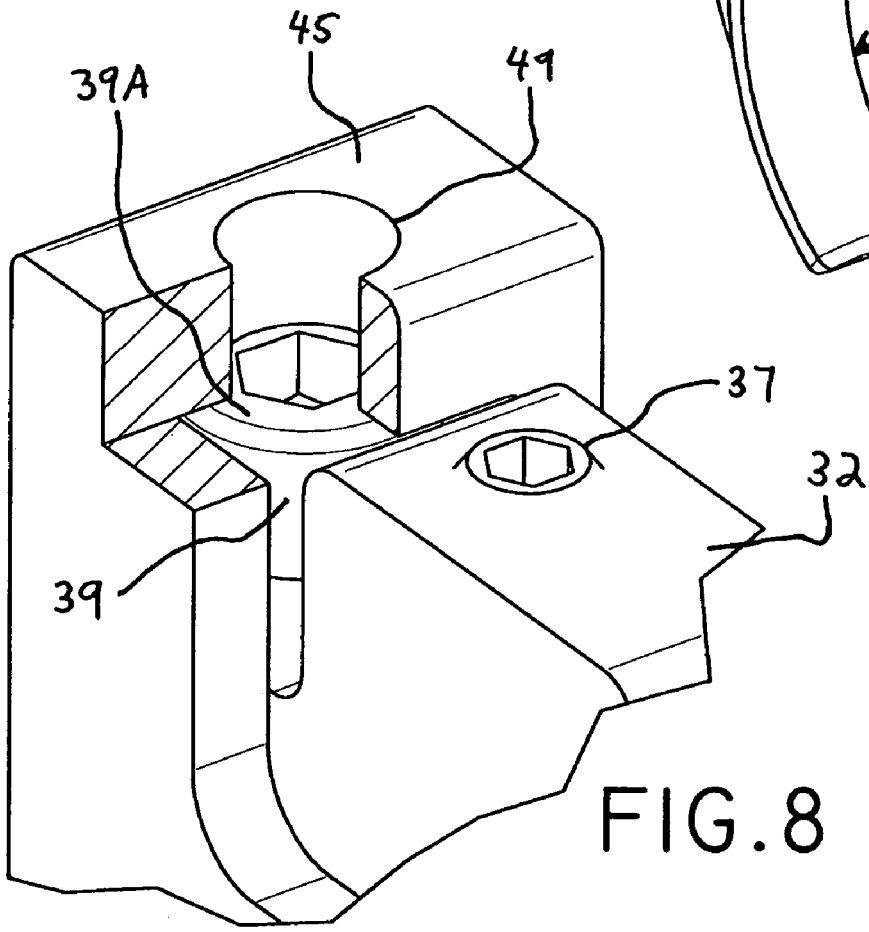
FIG. 8 is an enlarged view of the broken open section of the trigger assembly in FIG. 7 subtended by the dashed circle in FIG. 7, labeled 8.

FIG. 7 is a perspective view of trigger assembly 21 where overhanging tower 45 has been partially sectioned to show screw head surface 39A of sear engagement adjustment screw 39. FIG. 8 is an enlarged view of top of overhanging tower 45 that is shown in FIG. 7. The interface between tower 45 and screw head surface 39A is illustrated where screw head surface 39A bears against tower 45 and wrench access is provided by aperture 49 to sear engagement adjustment screw 39.

Figure 9:
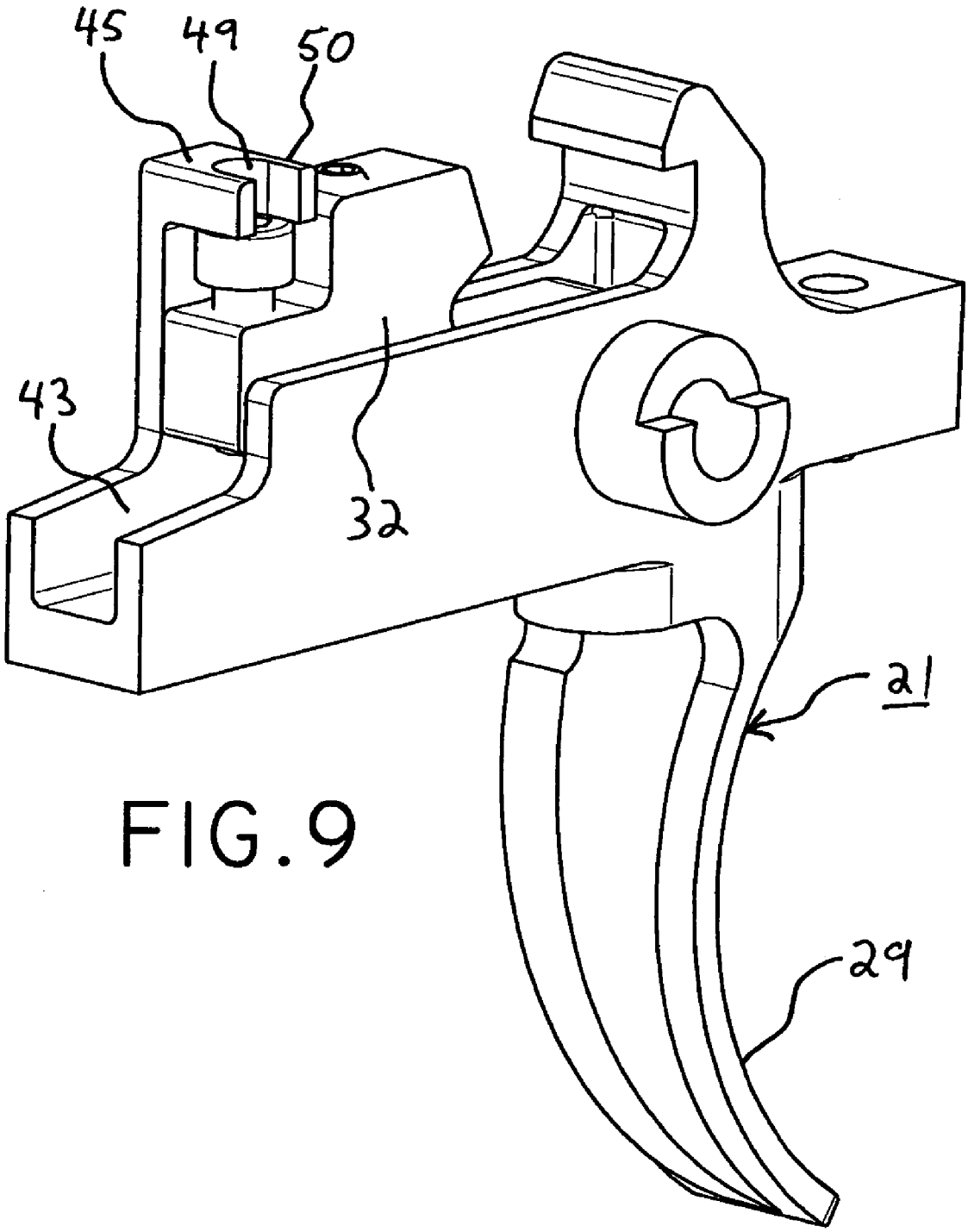
FIG. 9 is a perspective view of the trigger assembly that is part of the trigger mechanism according to the present invention.

FIG. 9 is another embodiment of the trigger assembly of the present invention showing the overhanging tower 45 and aperture 49 with overhanging ledge 50 as a cantilever beam rather than a simply supported beam straddling the trough 43. Although aperture 49 is shown breaking out of tower 45 it could just as easily perforate tower 45 in a location such that the overhanging ledge 50 of tower 45 surrounds aperture 49.

Figure 10:
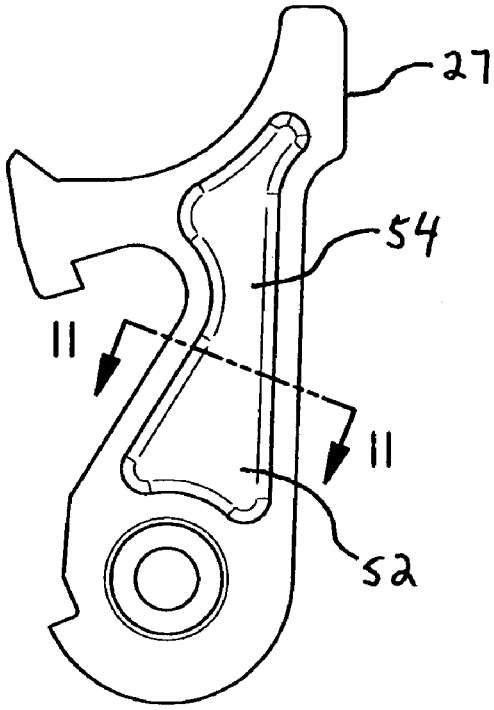
FIG. 10 is a side elevation of the hammer according to the present invention.
Figure 11:
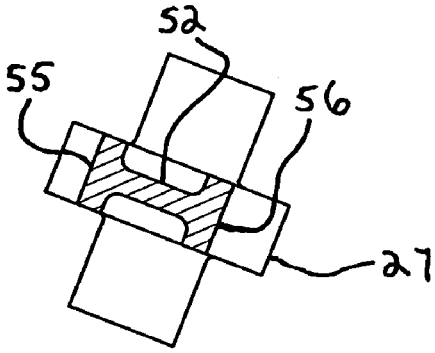
FIG. 11 is a sectional view on the line 11-11 of FIG. 10.

Turning to FIG. 10, which is a side elevation of hammer 27, depressed area 54 is shown. Depressed area 54 makes up one side of web 52 and another similar depressed area is present on the other side of hammer 27 to make up the other side of web 52. FIG. 11 is a section view of FIG. 10 on the line 11-11 where the I-beam profile of hammer 27 is clearly shown. The web 52 of the I-beam profile of hammer 27 supports the extending flanges 55 and 56. It should be noted that the I-beam profile does not need to encompass the entire hammer 27 but may be localized where weight reduction while retaining strength is needed.

Figure 12:
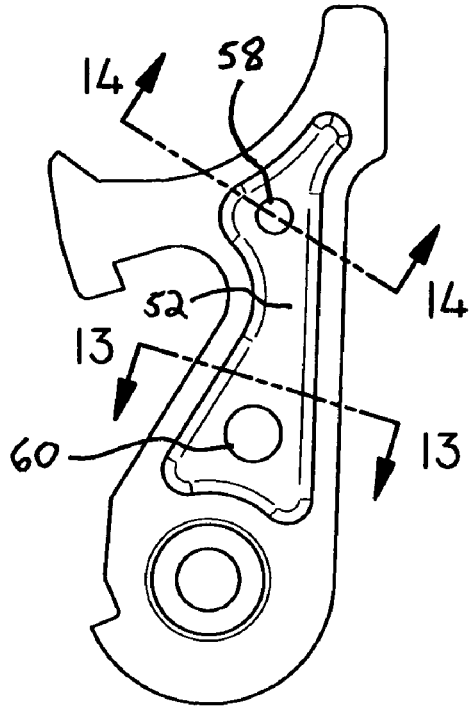
FIG. 12 is a side elevation of another embodiment of the hammer of the present invention.
Figure 13:
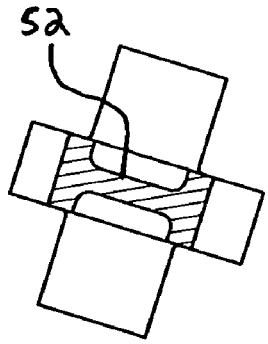
FIG. 13 is a sectional view on the line 13-13 of FIG. 12.
Figure 14:
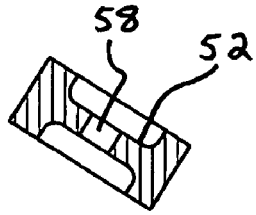
FIG. 14 is a sectional view on the line 14-14 of FIG. 12.

FIG. 12 is a side elevation view of another embodiment of hammer 27 with apertures 58 and 60 located within web 52. FIG. 13 is a section view of the hammer 27 of FIG. 12 on section line 13-13 that illustrates the I-beam profile of an area without an aperture in a manner similar to FIG. 11. FIG. 14 is a section view of hammer 27 of FIG. 12 on line 14-14 that illustrates the profile of hammer 27 near an aperture 58. Apertures 58 and 60 are shown perforating web 52. It should be noted that much of the beneficial affects of the I-beam profile of hammer 27 are still retained even with apertures located in web 52. Apertures extending through the web of an I-beam are common practice in structural member design. Although the strength of hammer 27 is lowered by an aperture such as aperture 58 in web 52 the areas of web 52 without an aperture such as sectioned by FIG. 13 can allow hammer 27 to remain sufficiently strong while allowing greater mass reduction that what can be attained solely by perforating the hammer 27 with apertures without I-beam web 52.

Other modifications may be made to this invention without departing from its scope as defined in the appended claims.

What is claimed is:

1. An adjustable dual stage trigger assembly comprising:

a spring powered hammer, a spring preloaded trigger, a spring loaded disconnector assembly;

said spring powered hammer being pivotally connectable with a first pin to the receiver of a firearm and having a primary sear hook and a secondary sear hook;

said spring preloaded trigger being pivotally connected with a second pin through said firearm receiver and having a trigger sear engaging said primary hammer sear hook when the firearm is in the cocked position;

said spring loaded disconnector assembly being pivotally connectable with said second pin and being operably connected with said trigger;

said trigger having a bridge over said spring loaded disconnector assembly;

a screw adjustable by a user of said firearm in said spring loaded disconnector assembly;

said bridge having a bottom surface contacting said screw in said spring loaded disconnector assembly;

said screw allowing said user to adjust engagement of said trigger sear with said primary hammer sear hook and causing a portion of said spring loaded disconnector assembly to contact a portion of said secondary hammer sear.

2. The adjustable dual stage trigger assembly of claim 1 wherein said bridge is of the cantilever type.

3. The adjustable dual stage trigger assembly of claim 1 wherein said bridge includes an opening;

said opening providing through access for a screw adjustability tool to pass through said bridge;

said screw adjustability tool is inserted into said opening to engage the head of said screw and adjust said screw.

* * * * *